US006492947B2

(12) United States Patent
Anderson

(10) Patent No.: US 6,492,947 B2
(45) Date of Patent: Dec. 10, 2002

(54) STRIPLINE FED APERTURE COUPLED MICROSTRIP ANTENNA

(75) Inventor: Joseph M. Anderson, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/847,100

(22) Filed: May 1, 2001

(65) Prior Publication Data

US 2002/0163468 A1 Nov. 7, 2002

(51) Int. Cl.[7] ..... H01Q 1/38

(52) U.S. Cl. ..... 343/700 MS; 343/767; 343/846

(58) Field of Search ..... 343/700 MS, 702, 343/845, 846, 847, 848, 767

(56) References Cited

U.S. PATENT DOCUMENTS 4,197,545 A * 4/1980 Favaloro et al. ..... 343/700 MS
4,291,312 A * 9/1981 Kaloi ..... 343/700 MS
4,531,130 A * 7/1985 Powers et al. ..... 343/700 MS
4,843,400 A * 6/1989 Tsao et al. ..... 343/700 MS
5,278,569 A * 1/1994 Ohta et al. ..... 343/700 MS
5,661,493 A * 8/1997 Uher et al. ..... 343/700 MS
6,072,434 A * 6/2000 Papatheodorou ..... 343/700 MS
6,181,279 B1 * 1/2001 Van Hoozen ..... 343/700 MS
6,198,437 B1 * 3/2001 Watson et al. ..... 343/700 MS

* cited by examiner

*Primary Examiner*—Don Wong
*Assistant Examiner*—Shih-Chao Chen
(74) *Attorney, Agent, or Firm*—Colin M. Raufer; Leonard A. Alkov; Glenn H. Lenzen, Jr.

(57) ABSTRACT

An aperture coupled microstrip patch antenna coupling circuit. Electromagnetic energy propagating along a stripline feedline is coupled through one of the ground plane surfaces through a tuned aperture to an adjacent microstrip feedline device, which may be a microstrip patch antenna. Undesirable propagation modes are suppressed by enclosing the aperture-coupled slot in a non-resonant cavity. Impedance matching is accomplished with an impedance matching section.

30 Claims, 5 Drawing Sheets

THEORETICAL INPUT MATCH AND AXIAL RATIO

THEORETICAL RADIATION PATTERNS FOR PRINCIPLE PLANES

STRIPLINE FED APERTURE COUPLED MICROSTRIP ANTENNA

This invention was made with Government support under Subcontract DASG60-90-C-0166. The Government has certain rights in this invention.

BACKGROUND OF THE INVENTION

1. Field of the Invention

The present invention relates to antennas and stripline to microstrip coupling circuits. More specifically, the present invention relates to aperture coupled stripline fed microstrip patch antennas and aperture coupled stripline to microstrip coupling circuits.

2. Description of the Related Art

Stripline and microstrip feedlines are commonly used at high operating frequencies, such as the VHF, UHF, microwave and millimeter wave frequency ranges. A stripline feedline is typically assembled from metal-clad printed circuit board substrate with two ground planes spaced apart by a dielectric substrate material. Within the dielectric material is a feedline which is formed as a flat conductive strip by etching away unwanted metal cladding. The physical dimensions of the feedline and dielectric material, as well as the dielectric constant of the dielectric material determine the impedance of the stripline feedline.

In a similar fashion, microstrip feedlines are formed from metal-clad printed circuit board substrate. A single ground plane and a feedline, spaced apart by the dielectric substrate material form the microstrip. The feedline is a flat conductive strip formed by etching away unwanted metal cladding. The impedance of the microstrip is a function of the thickness of the dielectric, its dielectric constant, and the physical dimensions of the feedline.

It is well understood by those skilled in the art that resonant structures can be formed using microstrip and stripline technology. Antennas are commonly fabricated as microstrip patches formed by etching away unwanted metal cladding, leaving behind a patch of metal cladding, the size of which is selected to be resonant at a particular frequency of operation. The patch is supported by the printed circuit board dielectric substrate over a ground plane, which is formed by the metal cladding on the opposite side of the printed circuit board.

A useful combination is to feed a microstrip patch antenna with a stripline feedline. In doing so, it is necessary to couple the signal between the antenna patch and the stripline feedline which is located between two ground planes. Drawing FIGS. 1A and 1B illustrate a prior art method of accomplishing the signal coupling.

Reference is directed to FIG. 1A which is a top view of the prior art stripline fed microstrip patch antenna. The stripline is formed with multiple metal-clad printed circuit board layers 1, which have a feedline 4 located therein. The microstrip patch antenna 2 is supported above the stripline 1 and is formed to the desired resonant characteristics. In this figure, the microstrip patch 2 is comer clipped to yield an antenna with circular polarization characteristics. The coupling of electromagnetic energy between feedline 4 to antenna patch 2 is accomplished with a coaxial feed comprising a coaxial opening 6 in the ground plane of the stripline structure 1 and a coaxial pin connector 7 which is conductively coupled to both feedline 4 and antenna 2. To prevent undesired electromagnetic propagation modes, several plated-through holes 8 are placed around the coaxial opening 6.

FIG. 1B shows a cross-section of the prior art stripline to microstrip patch antenna coupling circuit. The stripline 1 includes two dielectric substrate layers 10 and 12. At the outer edges of these two layers are ground plane surfaces 16 and 18, respectively. The feedline 4 is sandwiched between dielectric layers 10 and 12. The microstrip patch antenna 2 is insulated from the stripline 1 by dielectric layer 14. Energy is coupled from feedline 4 to antenna 2 by metal coaxial pin 6, which passes through coaxial opening 7 in ground plane layer 16. This form of coupling is known as "probe-coupling" or "coaxial coupling" by those skilled in the art. The plated through holes 8 conductively couple ground plane layers 16 and 18 for the purpose of suppressing undesired propagation modes.

The pin or 'probe' coupling techniques work well at the lower frequency ranges since the physical dimensions are relatively large allowing generous tolerance ranges. Also, hand assembly techniques are acceptable because the physical size of the components is such that they can be hand soldered with relative ease. However, as the desired frequency of operation increases, the component sizes decease. In the Q-band, for example, frequencies in the 44 GHz range, the wavelength requires components of very small physical size. The coaxial pin would be on the order of 0.010 inches in diameter. This diameter is so small that it becomes difficult to solder to the antenna. The process then requires a very skilled technician to do the assembly work. If reflow solder techniques are used, there is an increased possibility the solder will flow so as to bridge the small insulating regions. While larger- coaxial pin sizes could be utilized, the pin becomes too close to the antenna patch size and antenna performance is degraded. Likewise, the coaxial opening may need to be so large that it becomes significant with respect to the antenna patch size.

Thus there is a need in the art for a coupling circuit design to couple high frequency signals between stripline feedline circuits and microstrip circuits, such as microstrip patch antennas, which eliminate the need for coaxial, or probe, coupling techniques.

SUMMARY OF THE INVENTION

The need in the art is addressed by the apparatus of the present invention. One embodiment of the inventive apparatus is an aperture coupled antenna, including a stripline feedline with two ground planes positioned substantially parallel to each other with dielectric material in between them. A feedline is placed within the dielectric material thus forming a stripline feedline. A resonant opening is formed in one of the ground planes and is located adjacent to an end of the feedline. A non-resonant cavity is formed with several conductors connected between the two ground planes and is located around the resonant opening. An antenna is located adjacent to the resonant opening on the opposite side of the ground plane, with the resonant opening, from the feedline. This arrangement allows electromagnetic energy to be coupled between the feedline and the antenna through the resonant opening without the need to solder a pin or probe between the feedline and the antenna.

Coupling between a stripline feedline and an antenna is not the only useful application of the present invention. It is equally useful in any situation where a stripline feedline needs to be coupled to a microstrip circuit. A second apparatus is a stripline to microstrip coupling circuit, including a stripline feedline with two ground plane positioned substantially parallel to each other with dielectric material in between them. A feedline is placed within the dielectric material thus forming a stripline feedline. A resonant opening is formed in one of the ground planes and is located adjacent to an end of the feedline. A non-resonant cavity if formed with several conductors connected between the two ground planes, and is located around the resonant opening. A stripline conductor is supported by another dielectric material on the opposite side of the ground plane, with the resonant opening, from the feedline. The stripline conductor is located adjacent to the resonant opening. This arrangement allows electromagnetic energy to be coupled between the feedline and the microstrip conductor through the resonant opening.

DESCRIPTION OF THE INVENTION

Illustrative embodiments and exemplary applications will now be described with reference to the accompanying drawings to disclose the advantageous teachings of the present invention. While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1A:
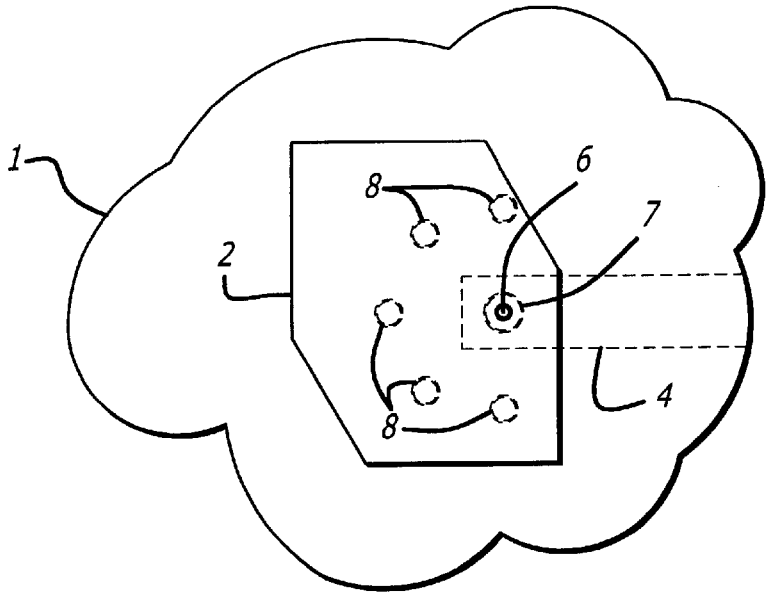
FIG. 1A PRIOR ART
FIGS. 1A and 1B depict the prior art stripline to microstrip coupling circuit with a top view and cross section respectively.
Figure 1B:
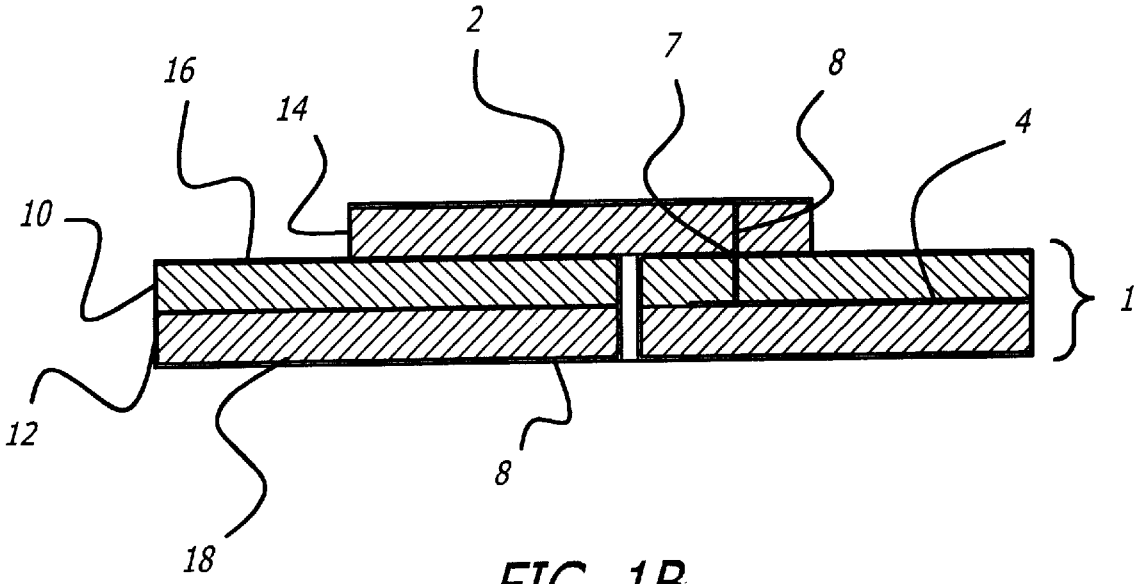
FIG. 1B PRIOR ART
Figure 2:
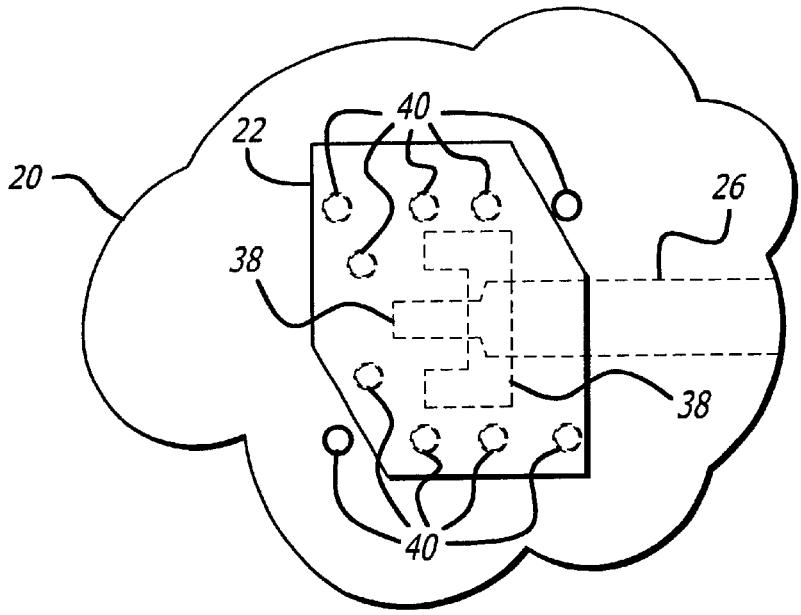
FIG. 2 is a view from the stripline side of an illustrative embodiment of the present invention.

Reference is directed to FIG. 2 which shows a view of an illustrative embodiment of the present invention, a stripline to microstrip patch antenna coupling circuit, as seen from the antenna side looking through the stripline circuit board. Hidden items are shown in phantom to illustrate the spatial relationship of each to the others. Present in this view are the stack of stripline printed circuit boards 20, the microstrip patch antenna 22, the feedline 26 within the stripline boards 20, the aperture coupling slot 38, and a plurality of plated-through holes 40, which are commonly referred to as "vias". Greater details for each of the foregoing items will be discussed with respect to the subsequent drawing views.

It will be understood by those of skill in the art that the illustrative circuit will typically be part of a much more complex circuit. Such circuit may include radio receiving, transmitting, and filtering circuits. In addition, there may be multiple instances of the present invention in a single circuit for the purpose of forming an array of antenna elements, for example.

Figure 3A:
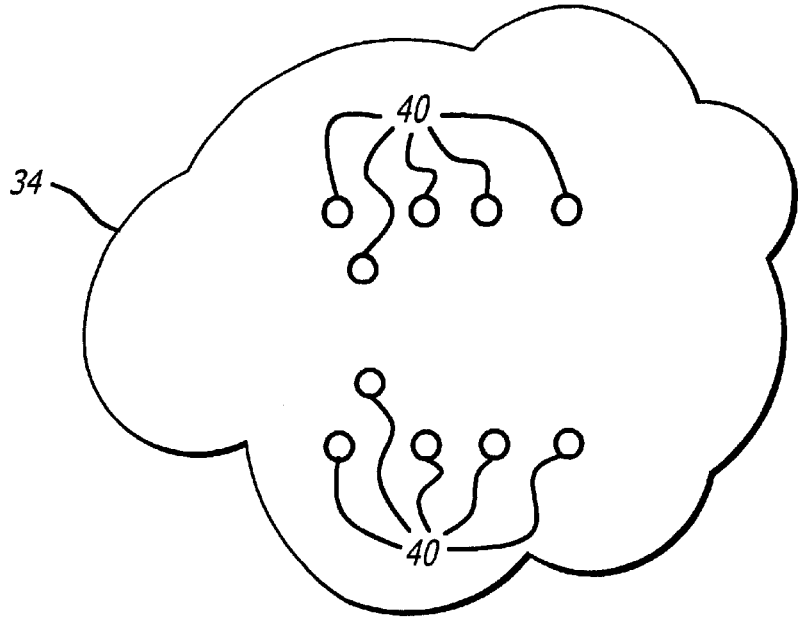
FIG. 3A is a view of the lower ground plane layer in an illustrative embodiment of the present invention.

Reference is directed to FIG. 3A which is a view of the lower ground plane printed circuit board 34. This printed circuit board 34 includes a ground plane metallic layer (not shown) and a dielectric layer (not shown). A plurality of holes 40 are drilled into printed circuit board 34. These holes will later be aligned with holes in other layers of the circuit and plated through to form conductive "vias" between the lower and upper ground plane layers. The use of "vias" is well known in the art for forming conductively coupled paths between various layers in a multi-layer printed circuit. The purpose of the arrangement of the plurality of holes 40 is to form a cavity space between the lower and upper ground planes layers. Essentially, all of the cavity dimension are less than one-half the wavelength of the desired operating frequency of the circuit. This causes the cavity to be non-resonant, as is well understood by those skilled in the art. The need for a non-resonant cavity will be discussed hereinafter.

Figure 3B:
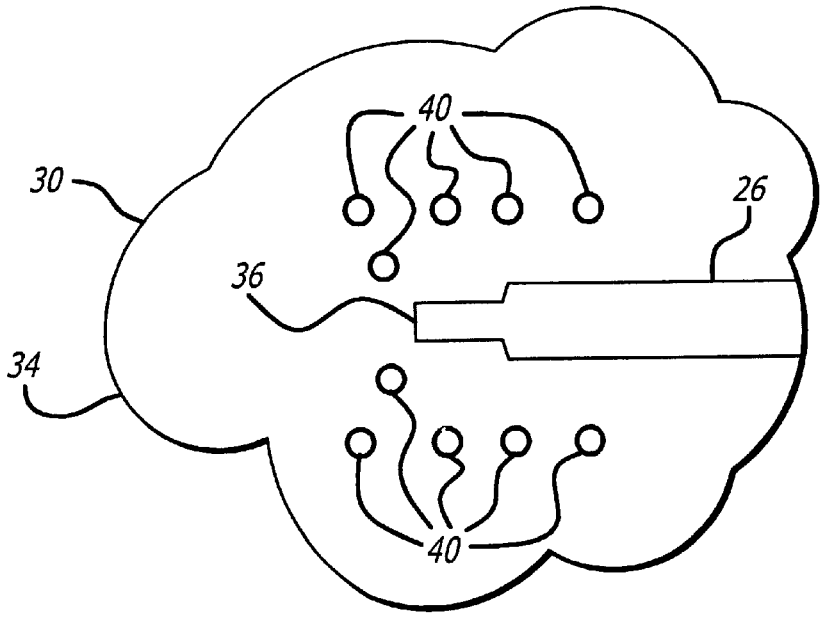
FIG. 3B is a view of the feedline layer in an illustrative embodiment of the present invention.

Reference is directed to FIG. 3B which is a view of the feedline layer within the stripline circuit 20 (not numbered in this view). The feedline layer is bonded to the dielectric material layer 30 of the lower ground plane 34. The feedline layer has a metallic feedline 26 which is coupled to other feed circuitry (not shown) and which terminates at a first end within the feedline layer. Since it is necessary to match the impedance of the feedline 26 with the coupling circuit (not shown in this view), a one-quarter wavelength tuning stub 36 is coupled to the end of feedline 26. The feedline 26 and tuning stub 36 or formed by photo-etching a metal-clad printed circuit board to remove all of the metal cladding except the desired feedline 26 and tuning stub 36. The impedance of the feedline 26 and tuning stub 36 are determine by their respective widths and thickness' and by the thickness and dielectric constant of the dielectric materials which support them.

The plated through holes 40 which were visible in FIG. 3A are also visible in this FIG. 3B because they must pass through all layers of the stripline circuit 20 (not numbered in this view).

Figure 3C:
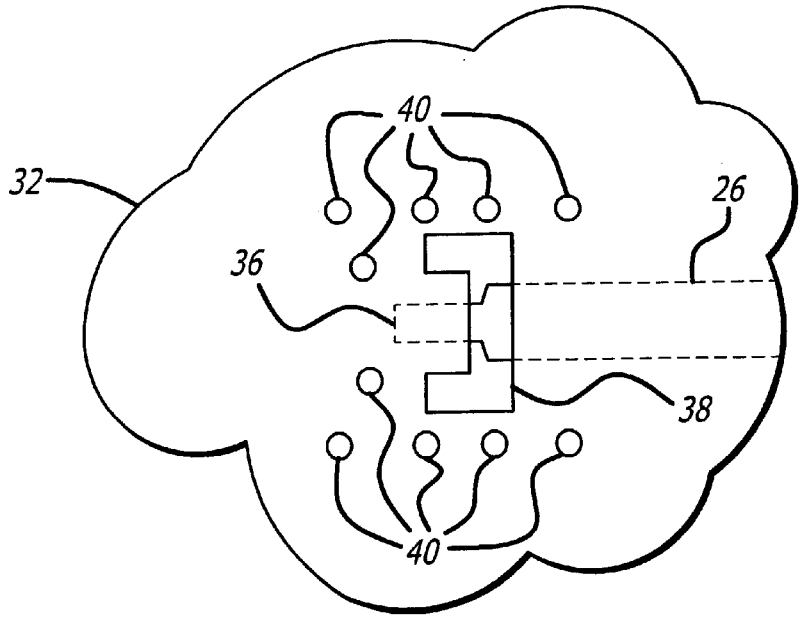
FIG. 3C is a view of the upper ground plane layer in an illustrative embodiment of the present invention.
Figure 3D:
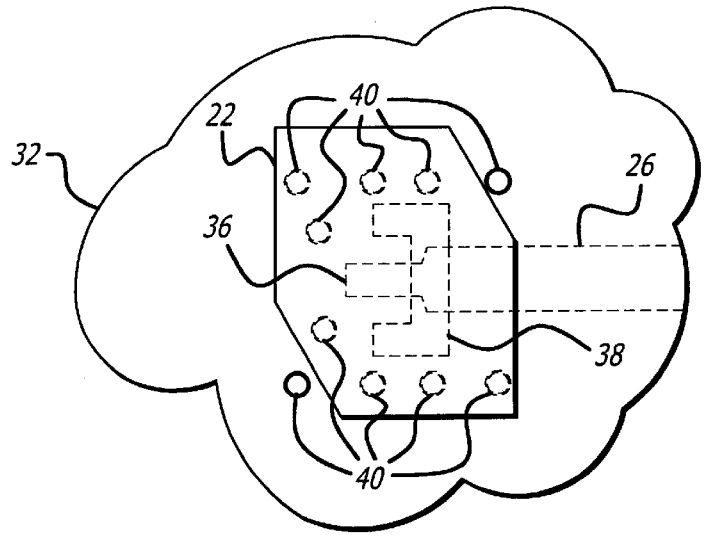
FIG. 3D is a view of the stripline antenna layer in an illustrative embodiment of the present invention.

Reference is directed to FIG. 3C which is a view of the upper ground plane layer 32 in this illustrative embodiment. The essential component in this upper ground plane layer 32 is the aperture coupling slot 38 which is formed therein. The slot 38 is a resonant opening by virtue of the fact that its proportions are such that it has a length of one-half of the wavelength of the desired operating frequency of the circuit being designed. Being a resonant element, couple in series with the feedline 26 below, the aperture slot has an impedance which is matched to the feedline impedance with the aforementioned tuning stub 36. The end of feedline 26 is located adjacent to, and directly below the aperture slot 38. The position illustrated in this FIG. 3C maximizes the efficiency of the coupling of energy between feedline 26 and aperture slot 38.

The aperture slot 38 is excited within the boundary created by the plated-through holes 40 and the upper ground plane 32 and lower ground plane 34 (not shown in this view). These boundaries create a cavity which needs to be non-resonant for the purpose of suppressing undesirable electromagnetic propagation modes. A stripline feedline supports current in both the feedline conductor 26 and the two ground planes 32 and 34. When the aperture coupling slot 38 is formed in the ground plane 32, the ground plane current is disturbed about the slot 38. As a result of this, the electromagnetic energy is coupled to the slot and the slot is thereby excited. When the antenna, or microstrip line, is placed on the other side ground plane 32 from the feedline 26, electromagnetic energy will couple between there between. However, the excited slot may support many different electromagnetic transmission modes, for example the parallel transmission line mode. In order to eliminate undesirable coupling to the other transmission modes, in particular the parallel plate TEM mode, the coupling slot is substantially enclosed by the aforementioned cavity. If the cavity mode was not suppressed, there would be additional undesirable losses.

In order to make the slot efficient at coupling energy, it needs to be one-half wavelength long. Since the cavity is non-resonant, the slot length is by definition larger than the cavity dimensions. This problem is overcome by folding the slot into a 'U' shaped slot. The 'U' shaped slot. provides substantially the same effective electrical length, but in a more compact area which will fit within the cavity 38 boundaries.

Figure 4:
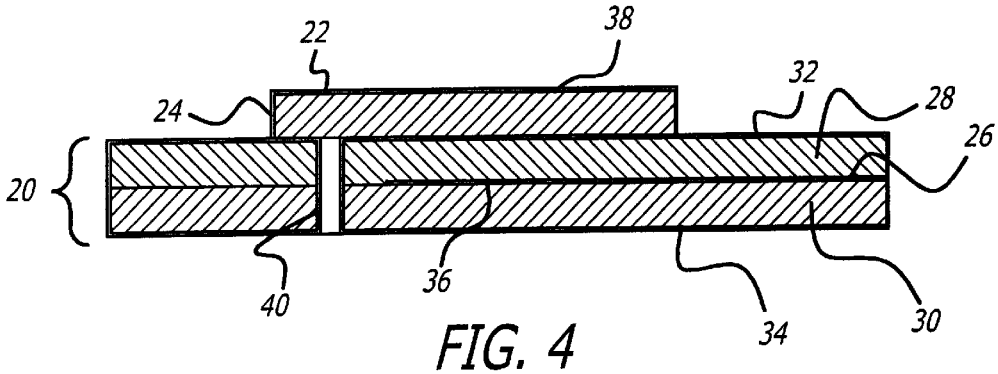
FIG. 4 is a section detail of the coupling circuit in an illustrative embodiment of the present invention.

Reference is directed to FIG. 4 which is a cross section of an illustrative embodiment of the present invention that is depicted in FIGS. 3A through 3D. The stacked structure of the stripline feedline 20 is clearly visible. The lower ground plane 34 is bonded to the lower half of the dielectric material substrate 30. The. upper ground plane 32 is likewise bonded to the upper half of the dielectric material 28. In between dielectric material halves 28 and 30 is the feedline conductor 26, to which end is coupled tuning stub 36. The printed circuit bards are bonded together using conventional techniques. These elements together form the stripline feedline 20.

Just above the point where feedline 26 is coupled to tuning stub 36, is the aperture coupled slot 38. Energy propagating along feedline 26 is electromagnetically coupled to aperture slot 38. The microstrip. patch antenna 22 is supported above aperture coupled slot 38 by dielectric material 24. This would typically be a printed circuit board onto which antenna 22 was etched. Energy is electromagnetically coupled from aperture coupled slot 38 to antenna 22, and, antenna 22 subsequently couples through radiation.

A single plated-through hole 40 is shown in this section view, but it is understood that a plurality of plated-through holes 40 are used (as shown in the other views) to form the cavity used to suppress undesirable propagation modes. As is understood by those skilled in the art, the dielectric materials and metal cladding used are selected for a variety of reasons. These include frequency of operation, dielectric constant, thickness, materials, dimensional stability, temperature stability, humidity stability, and resistance to environmental effects. Metal cladding may be copper, silver, gold, alloys of various types, as well as plated materials.

By utilizing an aperture coupled slot, the need for a coaxial pin is avoided. Also, the need for soldering is eliminated as well. This eliminates the labor intensive assembly process associated with coaxial coupling, and, results in a more accurate circuit that is less susceptible to assembly errors. The entire illustrative embodiment can be fabricated with near zero touch labor hours by simply etching, bonding, and plating the board layers. The major variable to be concerned about during assembly is board movement, which can be held tightly by using alignment pins.

Figure 5:
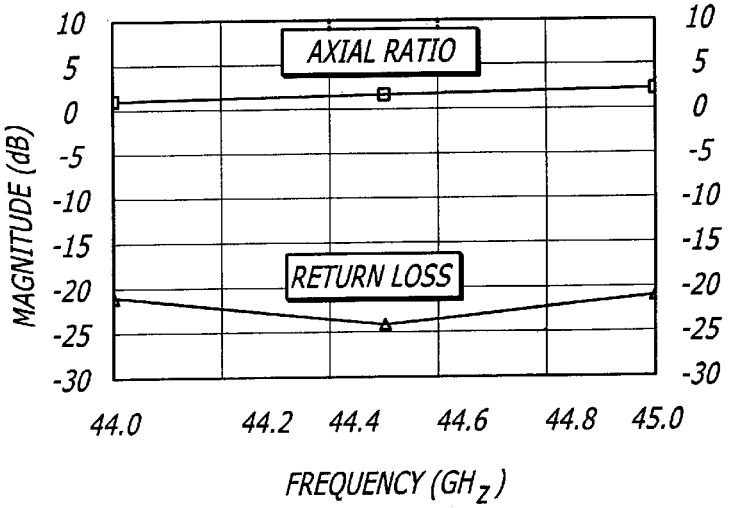
FIG. 5 is a diagram of the theoretical input match and axial ratio of the illustrative embodiment of the present invention.
Figure 6:
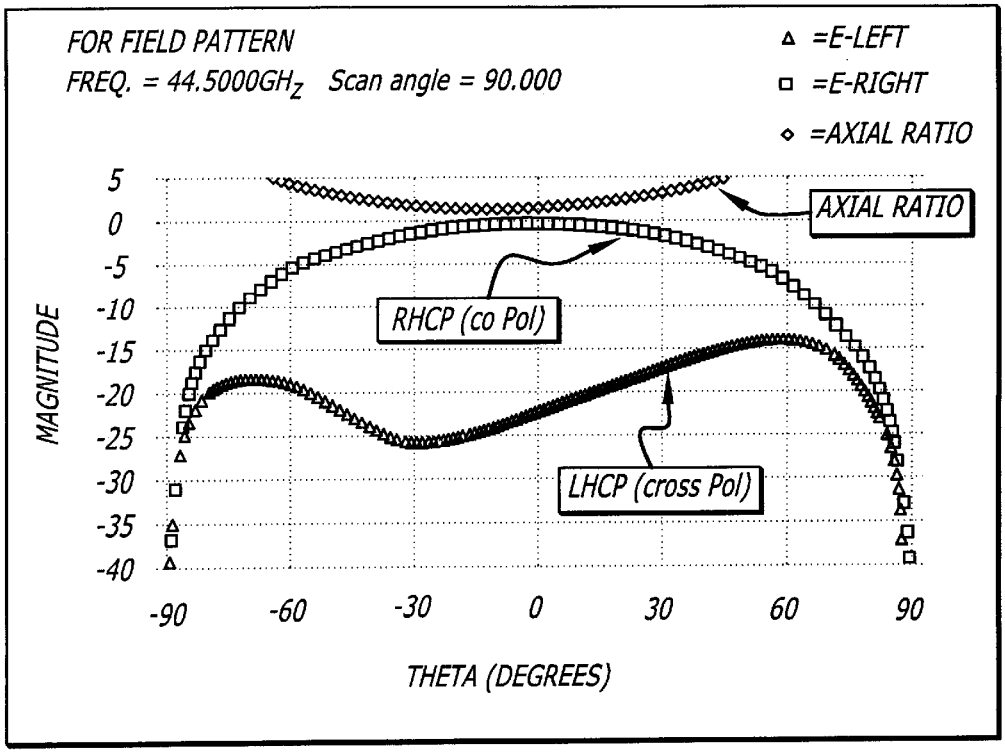
FIG. 6 is a diagram of the theoretical radiation patterns and principle planes of the illustrative embodiment of the present invention.
Figure 6:
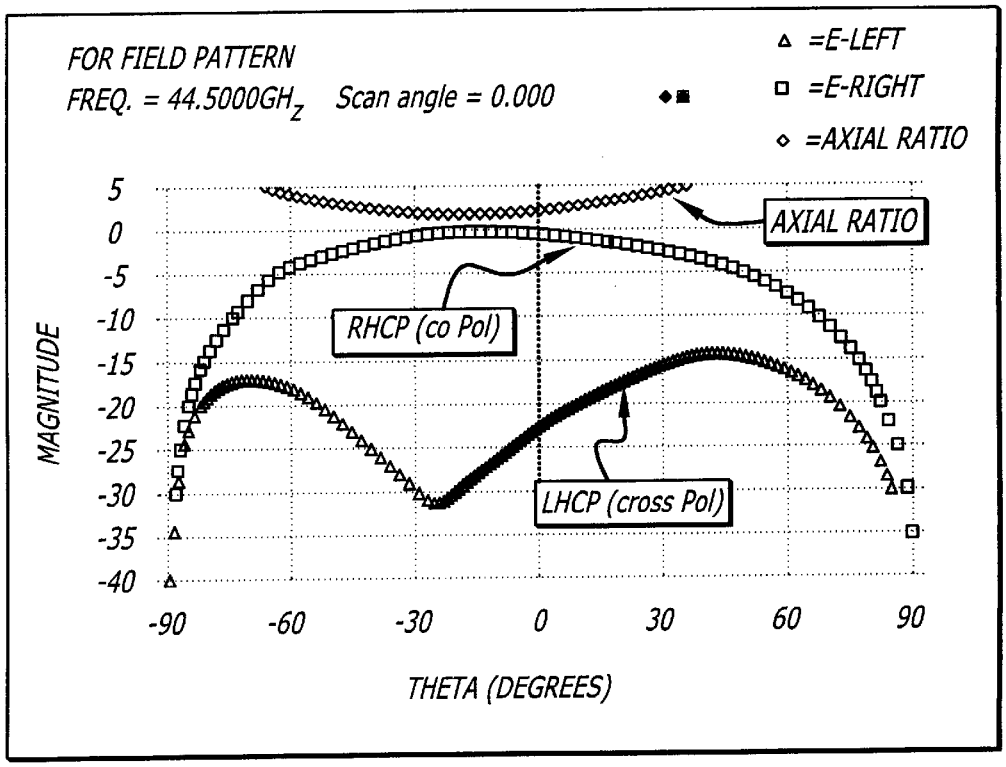

Reference is directed to FIGS. 5 and 6 which show the antenna performance of input match, axial ratio, and far field patterns. The performance is excellent with input match less than −20 dB across the entire band of operation. The axial ratio is less than 1.75 dB. The far filed patterns are typical of single element antenna. The cross-polarization component (LHCP) is less than −17 dB over the angular region of interest. Prior art techniques of coaxial coupling the patch generally have higher cross-polarization and less symmetrical radiation patterns due to the larger aperture in the ground plane and its placement being not centered within the patch. The gain is about 5 dBic indicating that most of the energy is being radiated by the patch and not absorbed by the cavity.

Thus, the present invention has been described herein with reference to a particular embodiment for a particular application. It is therefore intended by the appended claims to cover any and all such applications, modifications and embodiments within the scope of the present invention.

Accordingly,

What is claimed is:

1. An stripline aperture coupling device, comprising:

a stripline feedline having first and second ground planes and a feedline;

an aperture opening formed in said first ground plane, and a means for controlling electromagnetic coupling between said feedline and said aperture opening.

2. The device of claim 1 and wherein said means is a non-resonant cavity.

3. The device of claim 2 and wherein said non-resonant cavity is formed from at least one conductor.

4. The device of claim 3 and wherein said at least one conductor is disposed between said first and second ground planes.

5. The device of claim 2 and wherein said at least one conductor is a plated through hole.

6. The device of claim 1 further comprising a circuit element located adjacent to said aperture opening and wherein electromagnetic energy is coupled from said feedline to said circuit element.

7. The device of claim 6 and wherein said circuit element is an antenna.

8. The device of claim 7 and wherein said antenna is a microstrip patch antenna.

9. The device of claim 8 and wherein said microstrip patch antenna is a corner clipped microstrip patch antenna.

10. The device of claim 1 and wherein said aperture opening is resonant.

11. The device of claim 10 and wherein said resonant opening is one-half wavelength long.

12. The device of claim 10 and wherein said resonant opening is folded.

13. The device of claim 12 and wherein said resonant opening is folded in a 'U' shape.

14. An aperture coupled antenna, comprising:

a stripline feedline having a first ground plane and a second ground plane positioned substantially parallel to each other with a first dielectric material disposed therebetween, and having a feedline with a first end located within said first dielectric material;

a resonant opening, formed through said first ground plane, located adjacent to said first end of said feedline;

a non-resonant cavity for controlling coupling between said feedline and said resonant opening, formed from a plurality of conductors connected between said first and second ground planes, located about said resonant opening;

an antenna located adjacent to said resonant opening on the opposite side of said first ground plane from said feedline, and wherein electromagnetic energy is coupled between said feedline and said antenna through said resonant opening.

15. The antenna of claim 14 further comprising:

an impedance matching section coupled to said first end of said feedline that converts the impedance of said feedline to match the impedance of said resonant opening.

16. The antenna of claim 15 wherein said impedance matching section is a one-quarter wavelength stub.

17. The antenna of claim 14 wherein said resonant opening has a slot shape of approximate one-half wavelength length.

18. The antenna of claim 17 wherein said resonant opening slot shape is folded.

19. The antenna of claim 17 wherein said resonant opening slot shape is folded in a 'U' shape.

20. The antenna of claim 14 wherein said antenna is a microstrip patch antenna.

21. The antenna of claim 14 wherein said antenna is a microstrip patch antenna, and further comprising:

a second dielectric material located between said microstrip patch antenna and said first ground plane.

22. The antenna of claim 21 wherein said microstrip patch antenna is a corner-clipped microstrip patch antenna.

23. The antenna of claim 14 wherein said plurality of conductors are plated through holes.

24. A stripline to microstrip coupling circuit, comprising:

a stripline feedline having a first ground plane and a second ground plane positioned substantially parallel to each other with a first dielectric material disposed there between, and having a feedline with a first end located within said first dielectric material;

a resonant opening, formed through said first ground plane, located adjacent to said first end of said feedline;

a non-resonant cavity for controlling coupling between said feedline and said resonant opening, formed from a plurality conductors connected between said first and second ground planes, located about said resonant opening;

a stripline conductor supported by a second dielectric material on the opposite side of said first ground plane from said feedline, said stripline conductor located adjacent to said resonant opening, and wherein electromagnetic energy is coupled between said feedline and said stripline conductor through said resonant opening.

25. The circuit of claim 24 further comprising:

an impedance matching section coupled to said first end of said feedline that converts the impedance of said feedline to match the impedance of said resonant opening.

26. The circuit of claim 25 wherein said impedance matching section is a one-quarter wavelength stub.

27. The circuit of claim 24 wherein said resonant opening has a slot shape of approximate one-half wavelength length.

28. The circuit of claim 27 wherein said resonant opening slot shape is folded.

29. The circuit of claim 27 wherein said resonant opening slot shape is folded in a 'U' shape.

30. The circuit of claim 24 wherein said plurality of conductors are plated through holes.

* * * * *